US010502022B1

(12) United States Patent
Buck et al.

(10) Patent No.: US 10,502,022 B1
(45) Date of Patent: Dec. 10, 2019

(54) FLOWHEAD ASSEMBLY

(71) Applicant: M & M Oil Tools, LLC, Breaux Bridge, LA (US)

(72) Inventors: David A. Buck, Arnaudville, LA (US); Andy Paul Todd, Lafayette, LA (US)

(73) Assignee: M & M Oil Tools, LLC, Breaux Bridge, LA (US)

( * ) Notice: Subject to any disclaimer, the term of this patent is extended or adjusted under 35 U.S.C. 154(b) by 177 days.

(21) Appl. No.: 15/632,992

(22) Filed: Jun. 26, 2017

(51) Int. Cl.
*E21B 34/02* (2006.01)
*E21B 33/068* (2006.01)
*E21B 34/00* (2006.01)

(52) U.S. Cl.
CPC ..... *E21B 34/02* (2013.01); *E21B 33/068* (2013.01); *E21B 2034/002* (2013.01)

(58) Field of Classification Search
CPC ..... E21B 34/02
See application file for complete search history.

(56) References Cited

U.S. PATENT DOCUMENTS 2,301,355 A * 11/1942 Armentrout ..... F16K 1/427 138/45
7,040,408 B2 5/2006 Sundararajan et al.
8,752,653 B2 6/2014 Seneviratne et al.
2008/0257540 A1 10/2008 McGuire et al.
2011/0315370 A1 12/2011 McGuire
2013/0008666 A1* 1/2013 Cherewyk ..... E21B 23/08 166/373

FOREIGN PATENT DOCUMENTS

GB 2356239 * 5/2001

OTHER PUBLICATIONS

Drawing sheet of device, in public use in the United States prior to Jun. 26, 2016.

* cited by examiner

*Primary Examiner* — David J Bagnell
*Assistant Examiner* — Dany E Akakpo
(74) *Attorney, Agent, or Firm* — Jones Walker LLP

(57) ABSTRACT

In the specification and drawings a flowhead assembly is described and shown with a flow adapter positioned within a through bore of the flowhead assembly housing; a first ball valve and second ball valve located above the flow adapter; a spacer assembly positioned between the first and second ball valve; at least one side flow entry attachment fluidly connected with the through bore of the flowhead assembly. The sideflow entry attachment includes a first and second ball valve located in a central passage in the sideflow entry attachment housing, with a spacer assembly positioned between them; a flow guide insert is positioned above the ball valves and includes a flow path that is in fluid communication with the through bore of the flowhead assembly; a plug retains the flow guide insert within the central passage. Also described and shown is a frac head assembly including a flow adapter that has chamfered internal surfaces surrounding side entry apertures.

18 Claims, 8 Drawing Sheets

FLOWHEAD ASSEMBLY

I. BACKGROUND

Drilling for oil and gas often includes the use of corrosive, caustic, or abrasive fluids and materials being pumped through the flowheads and frac heads used during such operations. The corrosive, caustic, and/or abrasive fluids and materials compromise the interior surfaces of the flowheads and frac heads. Replacement of the flowhead and frac head parts is time intensive and costly.

II. BRIEF DESCRIPTION OF THE SEVERAL VIEWS OF THE DRAWINGS

III. DETAILED DESCRIPTION

Figure 1:
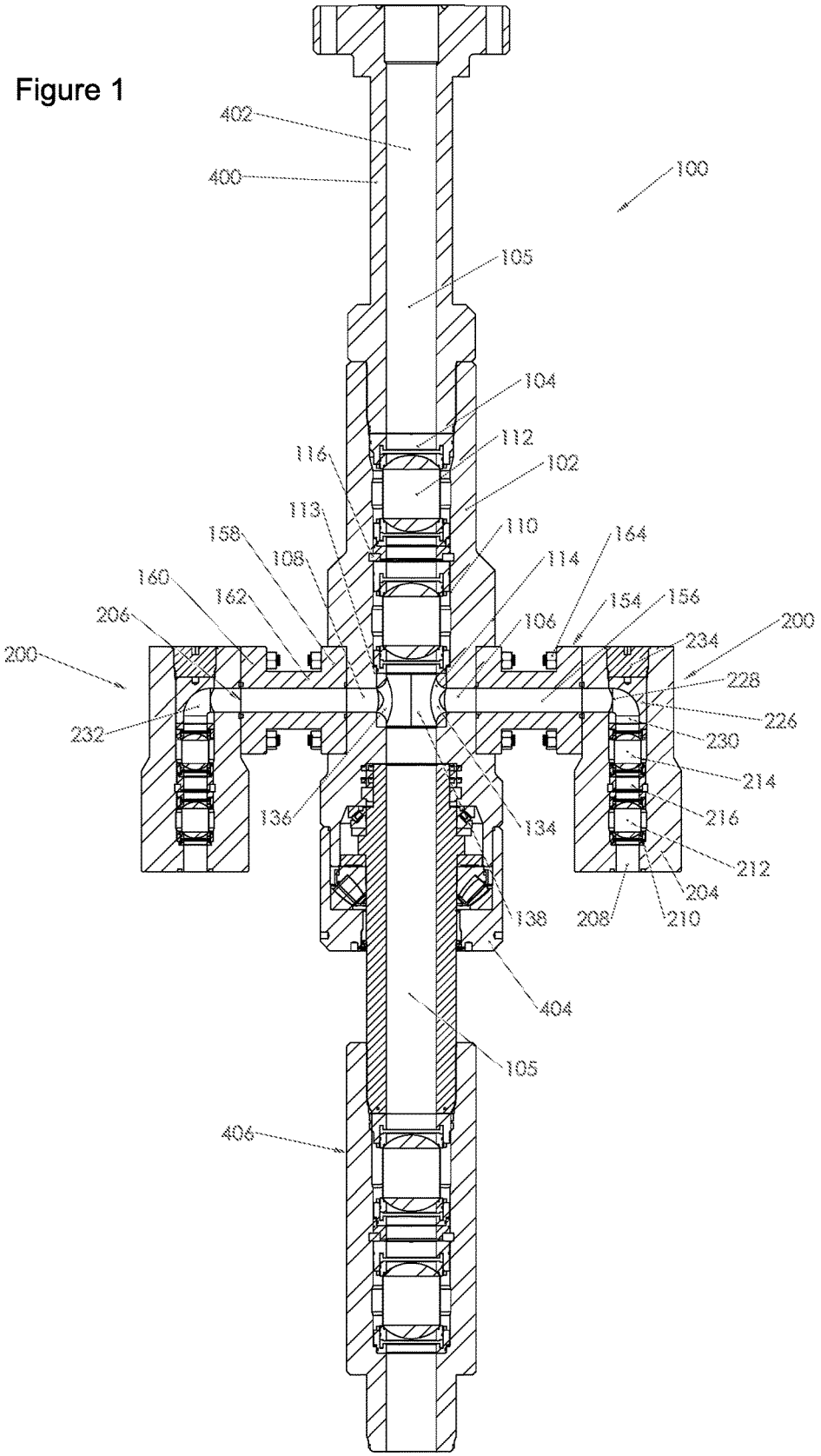
FIG. 1 is a sectional view of an embodiment of a flowhead assembly and a side flow entry attachment.
Figure 2:
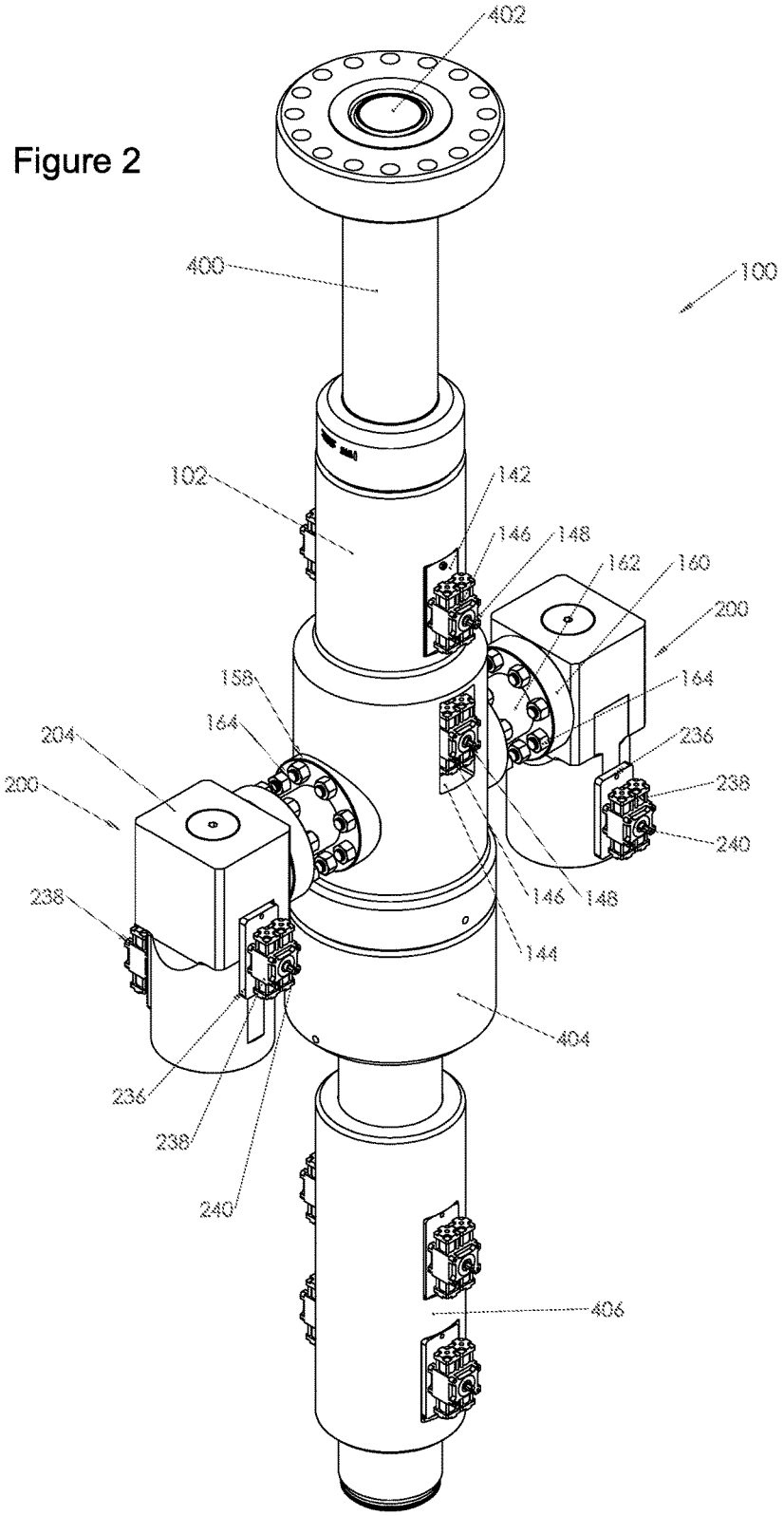
FIG. 2 is a perspective view of the embodiment of the flowhead assembly and side flow entry attachment shown in FIG. 1.
Figure 3A:
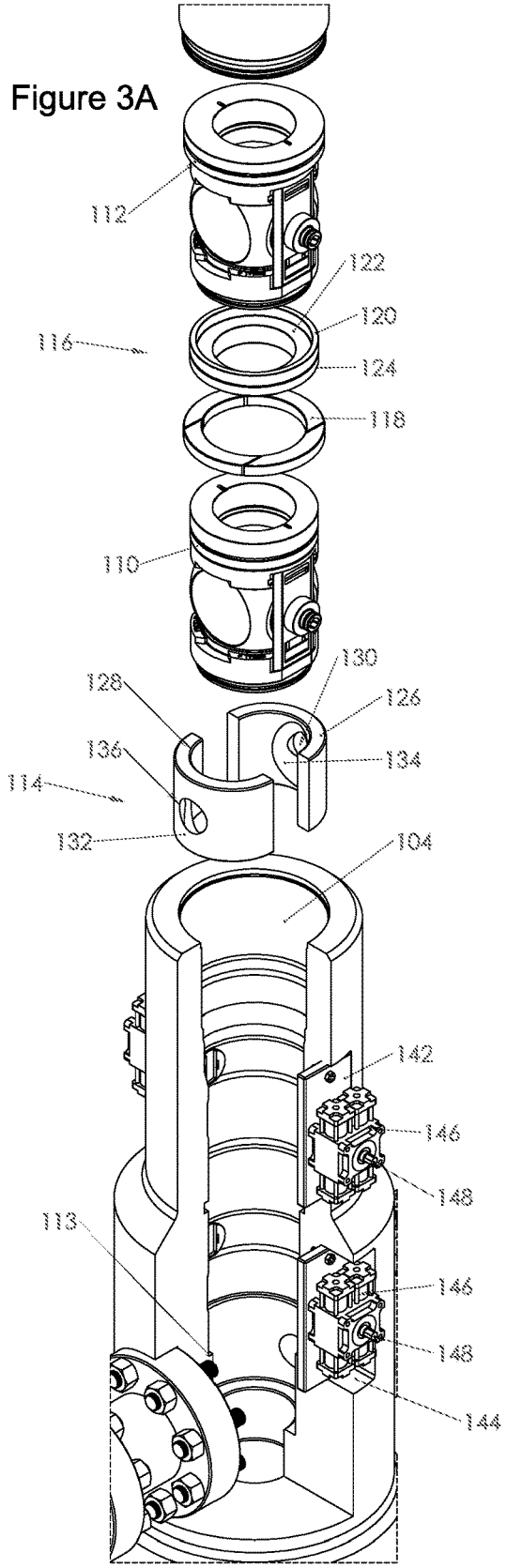
FIG. 3A is an exploded perspective view of the embodiment of the flowhead assembly shown in FIGS. 1 and 2.

Referring to the drawings, beginning with FIGS. 1 to 2, an exemplary embodiment of a flowhead assembly 100 is shown. The flowhead assembly can be used in oil and gas drilling operations, well workovers, or any other application where flowheads can be utilized. The flowhead assembly 100 includes a housing 102. In one embodiment, housing 102 is constructed of one piece. In another embodiment (not shown), housing 102 is constructed of a plurality of pieces. As shown in FIGS. 3A and 4, housing 102 has a through bore 104 that extends from the top end of housing 102 to the bottom end of housing 102. Housing 102 also has a first side aperture 106 and a second side aperture 108. Both first and second side apertures 106, 108 extend through the external surface of housing 102 and intersect the through bore 104. In one embodiment, and as shown in FIG. 1, first and second side apertures 106, 108 are positioned opposite each other. However, the two apertures need not always be position 180° apart, but could occupy other relative positions, e.g., 120° apart. Likewise, while FIGS. 1 to 3A and 4 show housing 102 with two side apertures, in other embodiments housing 102 includes two or more apertures.

Referring to FIGS. 1, 3A, and 4, flowhead assembly 100 also includes a first ball valve 110 and a second ball valve 112 positioned in through bore 104 above the first and second side apertures 106, 108 in housing 102. In one embodiment, first and second ball valves 110, 112 are cartridge valves. Through bore 104 has a first inner diameter. First ball valve 110 is retained in housing 102 by a diameter restriction in through bore 104. In the illustrated embodiment, the diameter restriction is formed by the flow adapter 114 (described further below), with the lower end of first ball valve 110 resting on the upper end of flow adapter 114. In other embodiments not illustrated, the diameter restriction could be either a reduction of the internal diameter, forming shoulder 113 in housing 102 or a split ring assembly such as described below for supporting the second ball valve 112.

Figure 4:
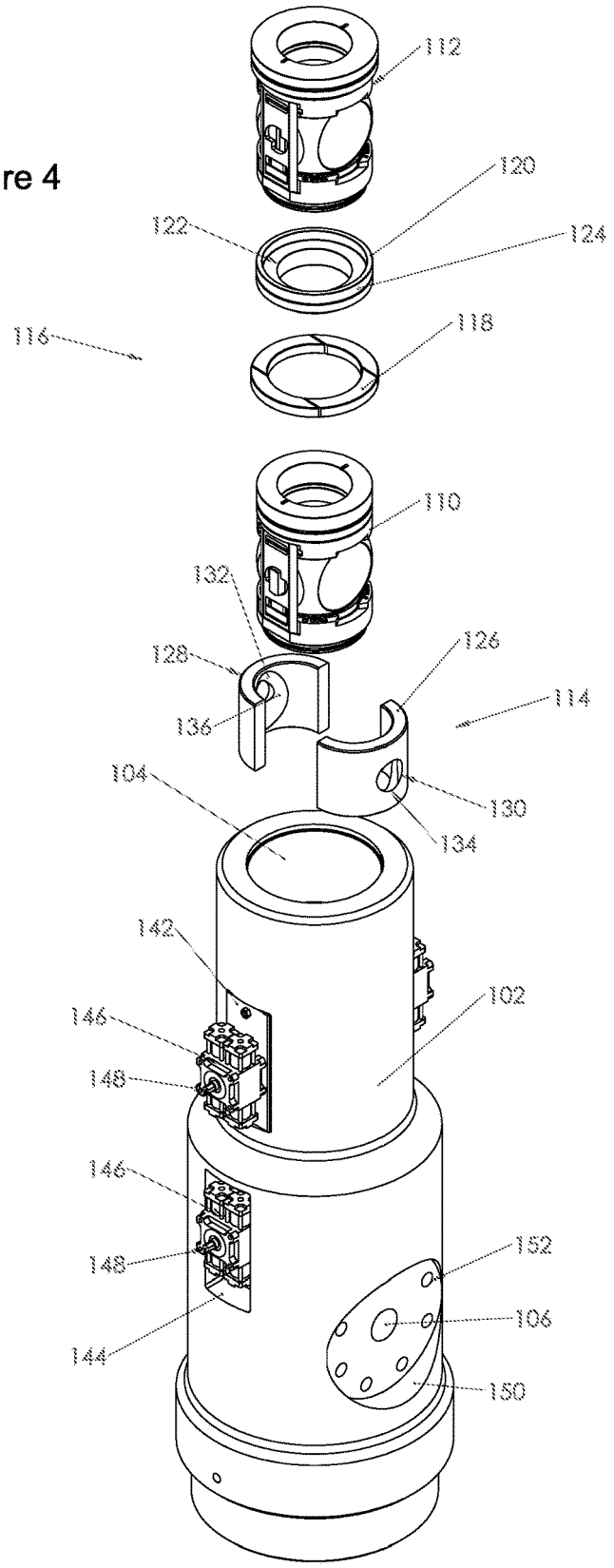
FIG. 4 is an exploded perspective view of an embodiment of a flowhead assembly.
Figure 5:
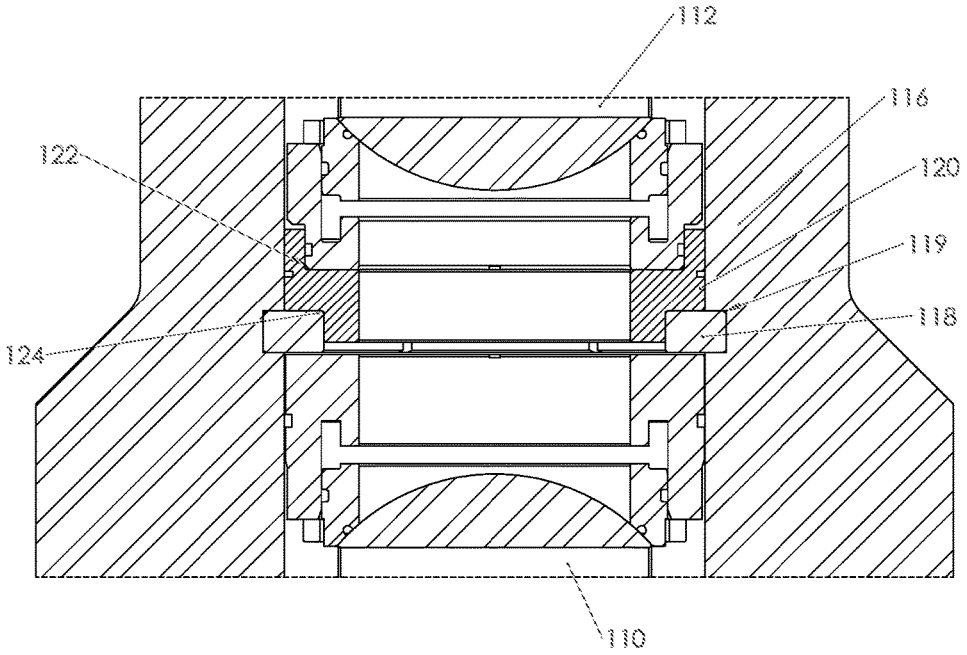
FIG. 5 is a sectional view of an embodiment of a spacer assembly.

As shown in FIGS. 1, 3A, and 4, first and second ball valves 110, 112 may be stacked on top of each other for a more compact ball valve positioning than in prior art applications. A spacer assembly 116 is positioned between the first and second ball valves 110, 112 in through bore 104 when first and second ball valves 110, 112 are in a stacked arrangement. Spacer assembly 116 allows first and second ball valves 110, 112 to be placed closer together than in prior art flowheads, which allows for a more compact flowhead assembly. Referring to FIGS. 3A, 4, and 5, spacer assembly 116 includes split ring 118 and split ring insert 120. Split ring 118 may be made of two or more pieces. In one embodiment, and as shown in FIGS. 3A and 4, split ring 118 is formed of four pieces. Split ring 118 is configured to fit within through bore 104 and is positioned above first ball valve 110.

Referring to FIG. 5, split ring insert 120 has a lower portion and an upper portion. The lower portion has an external diameter that is less than the external diameter of the upper portion. The external diameter of the upper portion is less than the diameter of through bore 104 so that split ring insert 120 can fit within through bore 104. The lower portion of split ring insert 120 also has an internal diameter that is less than the internal diameter of the upper portion. Internal shoulder 122 and external shoulder 124 are formed by the reduction in the internal and external diameter between the upper and lower portions. The external diameter of the lower portion is also less than the internal diameter of split ring 118. The lower portion of split ring insert 120 fits within split ring 118 and the external shoulder 124 is positioned on top of split ring 118. Split ring 118 is retained in position by engaging ring groove 119 formed in the wall of through bore 104. The internal diameter of the upper portion of split ring insert 120 is greater than the external diameter of second ball valve 112 so that the bottom of second ball valve 112 is retained within the upper portion of split ring insert 120.

It can be understood from FIG. 1 how both first and second ball valves 110, 112 may be inserted through the end of through bore 104 above flow adapter 114, which allows for a much quicker and easier replacement of the ball valves 110, 112 than in prior art flowhead assemblies. Generally, prior art flowhead assemblies insert the ball valves from opposing ends of the flowhead.

As shown in FIGS. 1, 3A, and 4, the flow adapter 114 may be positioned below first ball valve 110 and above a diameter restriction. In one embodiment, and as shown in FIGS. 3A and 4, flow adapter 114 may be made from a first member 126 and a second member 128. In other embodiments, flow adapter 114 may be integrally formed (not shown). First and second members 126, 128 are sized and shaped to fit within through bore 104. In one embodiment, first and second members 126, 128 may be arcuate shaped, as shown in FIGS. 3A and 4. First and second members 126, 128 each have side surfaces that are configured to abut the other member. First member 126 has side entry aperture 130 that extends from the external surface to the internal surface of first member 126. Second member 128 has side entry aperture 132 that extends from the external surface to the internal surface of second member 128. In one embodiment, as shown in FIGS. 1, 3A, and 4, first and second members 126, 128 each include a chamfered internal surface 134, 136 (respectively) about the side entry apertures 130, 132. In most general terms, the chamfer may be to whatever degree is needed to assist a smooth transition of flow direction. In certain embodiments, the radius of curvature of the chamfer will be between 25% and 75% of the diameter of the passage into which the fluid is flowing, e.g., the chamfered surfaces 134, 136 will be between 25% and 75% of the diameter of flange coupling passage 156. In many embodiments, the radius of curvature for chamfered internal surfaces 134, 136 can range from about 0.5 to about 2.0 inches. When the side surfaces of first and second members 126 and 128 abut one another, channel passage 138 is formed such that side entry apertures 130 and 132 intersect channel passage 138. Additionally, side aperture 130 aligns with first side aperture 106 in housing 102 and side aperture 132 aligns with second side aperture 108 in housing 102.

Referring to FIG. 1, flow adapter 114 is held in place by a diameter restriction. In one embodiment, as shown in FIG. 1, the diameter restriction can be a reduction in the internal diameter 140 of the housing 102. In another embodiment, the diameter restriction can be a retaining member such as a split ring (not shown). The diameter restriction forms a support shoulder such that the flow adapter 114 may be placed into through bore 104 from the same end as first and second ball valves 110, 112. Again, this facilitates quicker and easier replacement of flow adapter 114.

Flow adapter 114 may be configured to be any shape or size that corresponds to the internal surface of through bore 104. In one embodiment, flow adapter 114 has a cylindrical external surface. In another embodiment, flow adapter 114 could have a different external surface, e.g., a square (not shown), if through bore 104 had a corresponding shape. Typically, the channel passage 138 of flow adapter 114 will conform to the diameter of the passages through the ball valves, central channel 402 of lift sub 400, and the passage through valve sub 406. This will form a central flow passage 105 of uniform diameter through the entire flowhead assembly 100.

The channel passage 138 of flow adapter 114 may be subject to wear from the caustic, abrasive, and/or corrosive materials used in drilling operations. Therefore being able to replace flow adapter 114 in the field allows for less down time and cheaper repair costs for drilling operations. In one embodiment, the internal surface of channel passage 138, including internal chamfered surfaces 126, 128, is made from a wear-resistant material. In certain embodiments, the internal chamfered surfaces could be conventional steel or other alloy coated with a wear-resistant material. Non-limiting examples of wear-resistant materials include various grades of stainless steel, Inconel, low alloy steel, etc. In certain embodiments, the hardness of the wear-resistant material will range between 22 and 68 Rockwell C. In other embodiments, the flow adapter would not have a hardened surface or be formed of any special material and it is anticipated that the flow adapter simply would be more frequently replaced as it under goes normal wear.

Referring to FIGS. 2-4, in one embodiment actuator mounting plates 142 are affixed to the external surface of the housing 102. Additionally, housing 102 may include recessed areas 144 in the external surface of housing 102. Actuators 146 may be operably connected to the actuator mounting plate 142 and/or positioned within recessed area 144. Housing 102 also includes actuator stem rod apertures (hidden from view) sized and shaped so that actuator stem rod 148 can operably engage the ball valves 110, 112 positioned within the through bore 104.

Still referring to FIGS. 1-2, flowhead assembly 100 may be operably connected to at least one side flow entry attachment 200. In one embodiment, housing 102 includes recessed area 150 that includes bolt bores 152 (FIG. 4). Recessed area 150 is sized and shaped to receive a flanged coupling 154 (FIG. 1). Flanged coupling 154 operably connects housing 102 to side flow entry attachment 200. In one embodiment, as shown in FIGS. 1 and 2, flanged coupling 154 is an adapter spool flange. Flanged coupling 154 includes a first flange 158, a second flange 160, and a middle portion 162 between the first and second flanges 158, 160. Central passage 156 extends through flanged coupling 154. Conventional fasteners (e.g., bolts, screws, rods, nuts, etc.) connect first flange 158 to housing 102 and second flange 160 to side entry flow attachment 200. The figures illustrate steel threaded rods employed as fasteners 164. It can be seen in FIG. 1 how flanged coupling 154 creates a flow path between through bore 104 and side flow entry attachment 200. In one embodiment, the flowhead assembly 100 may include two side flow entry attachments 200. In alternate embodiments, the flowhead assembly 100 may include more than two side flow entry attachments 200 or possibly only one.

Figure 3B:
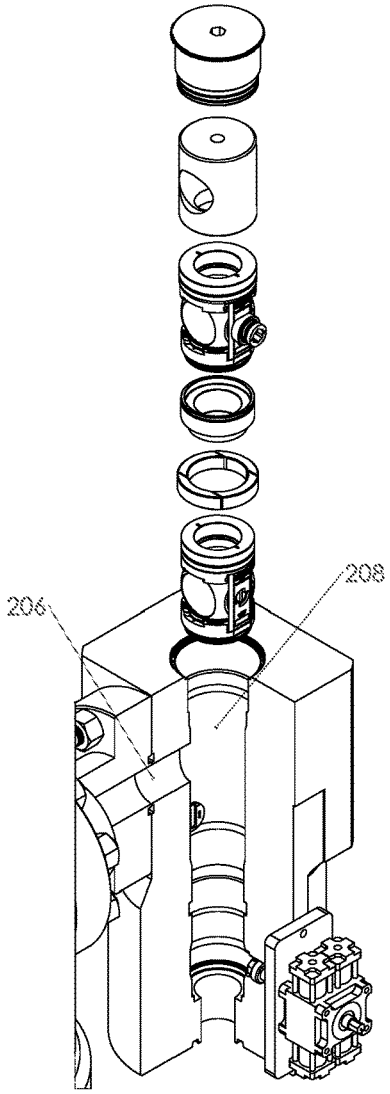
FIG. 3B is an exploded view of the side flow entry attachment shown in FIGS. 1 and 2.

Referring now to FIG. 3B, side flow entry attachment 200 includes a central passage 208 extending from one end of housing 204 to the other end of housing 204. Side flow entry aperture 206 extends through an exterior surface of the housing 204 to central passage 208. In one embodiment, side flow entry aperture 206 intersects central passage 208 at a substantially perpendicular angle. Central passage 208 includes a diameter restriction 210 positioned beneath the side flow entry aperture 206 (FIG. 1). In one embodiment, and as shown in FIG. 1, the diameter restriction is a reduction in the internal diameter (also referenced by 210) of central passage 208. In another embodiment, the diameter restriction can be a retaining member (not shown).

Figure 6:
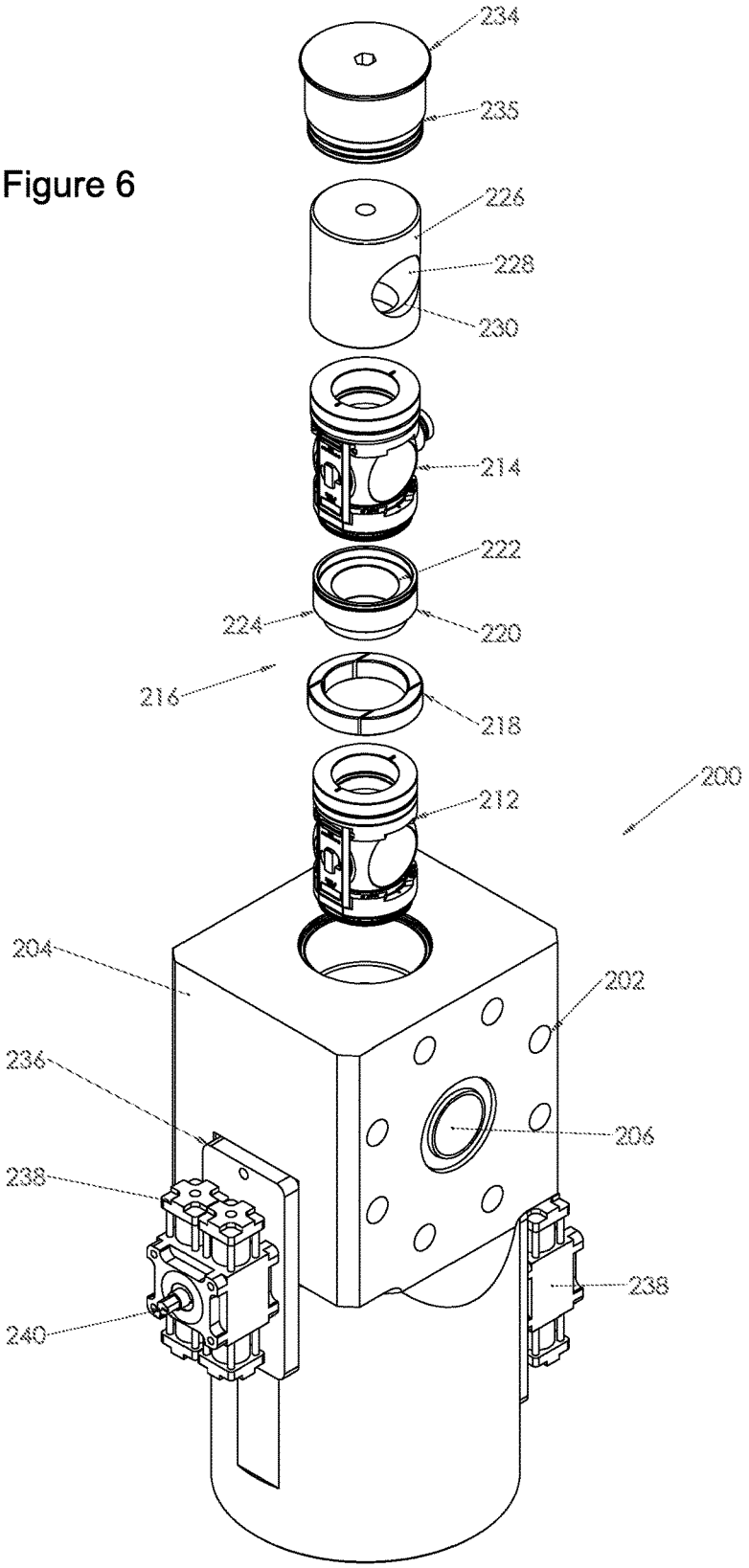
FIG. 6 is an exploded perspective view of an embodiment of a side flow entry attachment.

Referring to FIG. 6, side flow entry attachment 200 includes at least one ball valve 212 in the central passage 208. Ball valve 212 is positioned below the side flow entry aperture 206 and is retained in central passage 208 by the diameter restriction. In one embodiment, side flow entry attachment 200 includes a second ball valve 214 positioned above first ball valve 212 and below side flow entry aperture 206.

As shown in FIGS. 1 and 6, first and second ball valves 212, 214 may be stacked on top of each other for a more compact ball valve positioning. A spacer assembly 216 is positioned between the first and second ball valves 212, 214 in a stacked arrangement. Spacer assembly 216 allows first and second ball valves 212, 214 to be placed closer together than in prior art flowheads, which allows for a more compact flowhead assembly. In more typical embodiments, the top of the second ball valve 214 is within about 4 inches to 12 inches (or any sub-range in between) from the bottom of the first ball valve 212. In other embodiments this distance is under 25 inches (or any subrange between 0 and 25 inches).

Referring to FIG. 6, spacer assembly 216 includes split ring 218 and split ring insert 220. Split ring 218 may be made of two or more pieces. In the FIG. 6 embodiment, split ring 218 is formed of four pieces. Split ring 218 is configured to fit within central passage 208 and is positioned above first ball valve 212. Split ring 218 and split ring insert 220 will support second ball valve 214 in the same manner as previously described in reference to split ring 118, split ring insert 120, and ball valve 112.

Figure 7:
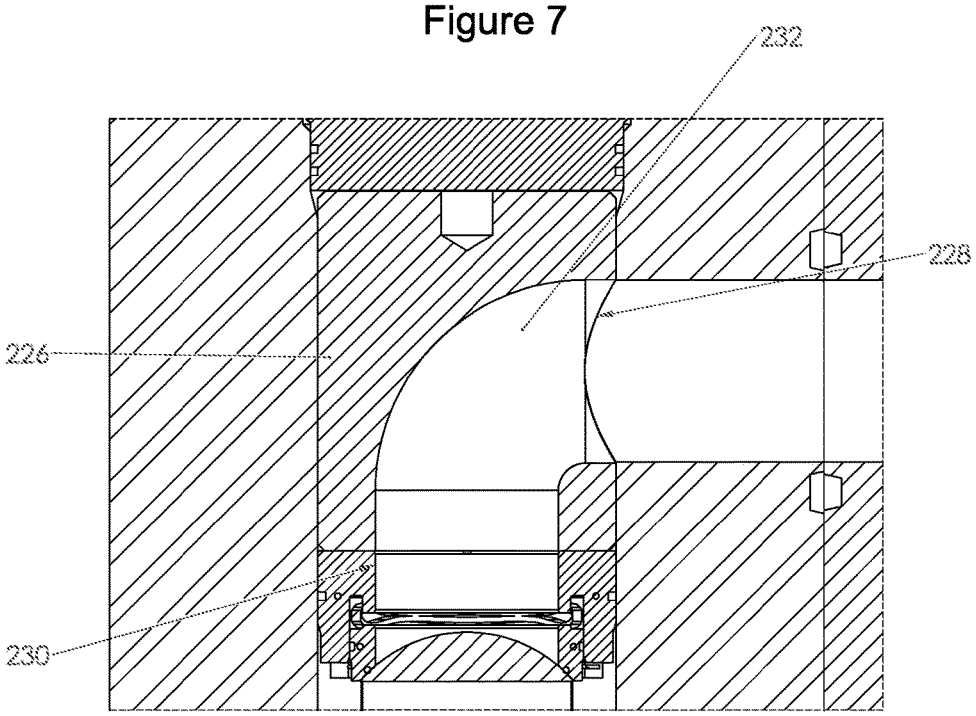
FIG. 7 is a sectional view of an embodiment of a flow guide insert.

Referring to FIGS. 1, 6, and 7, side flow entry attachment 200 includes flow guide insert 226 positioned within central passage 208. As best shown in FIG. 7, flow guide insert includes a side aperture 228 and a bottom aperture 230. A flow passage 232 begins at side aperture 228 and transitions to bottom aperture 230. As shown in the FIG. 7 embodiment, the transition of the flow passage 232 is along a curved surface. In certain embodiments, the flow passage 232 includes a chamfered internal surface to reduce abrasion by high pressure liquid flowing through the flow passage 232. As with earlier described chamfered surfaces 134, 136, the apertures 228 and 230 may be chamfered such that the radius of curvature of the chamfer will be between 25% and 75% of the diameter of the passage into which the fluid is flowing. However, other embodiments could employ an internal surface which is not chamfered. In the illustrated embodiments of flow guide insert 226, a liquid flowing through flow passage 232 is redirected by substantially 90°. However, other embodiments could redirect liquid flow at an angle of less than 90° (e.g., between about 45° and about 90°) or could direct flow in the opposite direction illustrated, or could have multiple outlet apertures. The internal surface of flow passage 232 of flow guide insert 226 is subject to wear, particularly along the chamfered internal surface where redirection of the liquid occurs. In one embodiment, the internal surface of central passage 232 includes wear-resistant materials as described above. Although not seen in the figures, certain embodiments of flow guide insert 226 may include a key on its outer surface configured to engage a groove along the internal surface of central passage 208. The key and groove would act to insure the alignment of side aperture 228 with passage 156 (see FIG. 1). Alternatively, this alignment could be carried out with using a cube-shaped flow guide insert and a square cross-section in the corresponding part of central passage 208.

Referring to FIGS. 1, 3B, and 6, this embodiment of side flow entry attachment 200 includes removable plug 234. Plug 234 extends into the upper end of central passage 208 and retains the ball valves 212, 214 and flow guide insert 226 within central passage 208. The illustrated plug 234 includes external threads that correspond to an internal threaded surface positioned at the upper end of central passage 208. However, other embodiments of plug 234 could be retained in central passage 208 with a fastener (not shown), such as a bolt, screw, rod, or nut. As shown in the FIG. 1 embodiment, plug 234 may be positioned within central passage 208 so that the top of plug 234 is flush with the top of housing 204, but this does not need to be the case in other embodiments. The bottom of plug 234 will typically fit closely against the top of flow guide insert 226, but not necessarily place any force on flow guide insert 226. Plug 234 may also include a seal groove 235 (FIG. 6) which carries an o-ring for sealing between plug 234 and the central passage 208.

Referring to FIG. 1, the diameter restriction 210 in central passage 208 facilitates the ball valves 212, 214, the spacer assembly 216, and the flow guide insert 226 all being inserted into central passage 208 from the top end of the side flow entry attachment 200. This allows the replacement of components in the side flow entry attachment 200 without removal of the housing 204 from the flanged coupling 154. Being able to replace the components of the side flow entry attachment 200 without removal from the flanged coupling 154 allows for faster and less expensive replacement of those components in the field. Referring to FIGS. 2, 3B, and 6, actuators 238 may be operably connected to the external surface of housing 204 in a similar manner as described above in reference to actuators 146 and housing 102.

Referring to FIG. 1, the upper end of the housing 102 of the flowhead assembly 100 is connected to lift sub 400. Although not explicitly shown, it will be understood that lift sub 400 is typically connected to a traveling block or other lifting mechanism employed by the drilling rig. A central channel 402 extends through lift sub 400 to communicate with through bore 104. The lower end of housing 102 of the flowhead assembly 100 is connected to swivel assembly 404 such as described in U.S. Application Ser. No. 62/216,848, which is incorporated by reference herein in its entirety. A valve sub 406 is positioned below swivel assembly 404. The connections between the lift sub 400, housing 102, swivel assembly 404, and valve sub 406 are typically threaded; however, other conventional, nonthread based, connection types could be employed in alternative embodiments.

Figure 8:
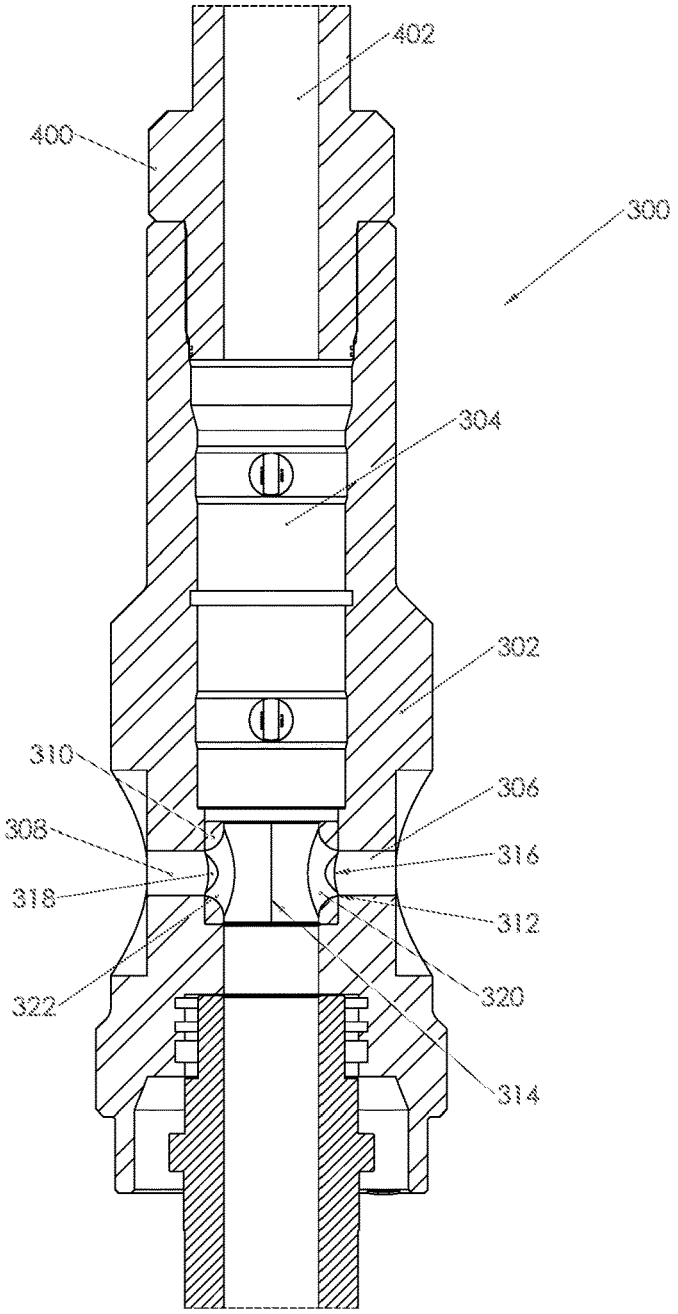
FIG. 8 is a sectional view of an embodiment of a frac head assembly.

Now referring to FIG. 8, an exemplary embodiment of a frac head assembly 300 is shown. The frac head assembly can be used in oil and gas fracking operations or any other application where frac heads can be utilized. The frac head assembly 300 includes a housing 302. In one embodiment, housing 302 is constructed of one piece, but in other embodiments (not shown), housing 302 could be constructed of a plurality of pieces. Housing 302 has a through bore 304 that extends from the top end of housing 302 to the bottom end of housing 302. Housing 302 also has a first aperture 306 and a second aperture 308, both of which extend through the external surface of housing 302 and intersect the through bore 304. In one embodiment, and as shown in FIG. 8, first and second apertures 306, 308 are positioned opposite each other. However, in other embodiments housing 302 may include apertures at relative orientations other than 180°, or may include three or more apertures. Certain embodiments could have two sets of inserts at different elevations, i.e., the apertures could also be vertically offset from one another in housing 302.

Through bore 304 has a first inner diameter and a second inner diameter that is smaller than the first inner diameter, thereby forming a diameter restriction in through bore 304. The diameter restriction can be a reduction in the internal diameter, forming shoulder 312 in through bore 304, as shown in FIG. 8. Alternatively, the diameter restriction may be a retaining member (not shown). In the illustrated embodiment, the diameter restriction is positioned below first and second apertures 306, 308.

A flow adapter 310, similar to flow adapter 114 discussed above, is positioned in through bore 304 resting on shoulder 312. Flow adapter 310 may be integrally formed or may be formed of a plurality of members. Flow adapter 310 includes a channel passage 314 aligned with through bore 304, a first side entry aperture 316, and a second side entry aperture 318. First and second side entry aperture 316, 318 intersect channel passage 314. First side entry aperture 316 is aligned with first aperture 306 in housing 302 while second side entry aperture 318 is aligned with second aperture 308.

Still referring to FIG. 8, flow adapter 310 includes internal chamfered surfaces 320, 322 around the first side entry aperture 316 and second side entry aperture 318, respectively. The internal chamfered surfaces 320, 322 that are positioned around first and second side entry aperture 316, 318 reduce the wear to channel passage 314. In embodiments where the frac head assembly 300 includes more than two side entry apertures, flow adapter 310 naturally includes a corresponding number of side entry apertures with internal chamfered surfaces. In one embodiment, the internal surface of channel passage 314, including internal chamfered surfaces 320, 322 is made of the wear-resistant material previously described. As with the previously described flow adapters 114, flow adapter 310 may be inserted into through bore 304 from one end (the end associated with the first, wider inner diameter). Additionally, by including the flow adapter 310, the channel passage 314, which will be abraded by the caustic, abrasive, and/or corrosive materials used during fracking operations, can be easily replace in the field without the need to replace the entire frac head assembly 300. This saves time and reduces costs in performing fracking operations.

Referring to FIGS. 1 and 4, to assemble the flowhead assembly 100, a flow adapter 114 is placed into the through bore 104 from end of the housing 102. Flow adapter 114 is retained in through bore 104 by the reduction in diameter 140 of the through bore 104. Flow adapter 114 is positioned so that side entry aperture 130 is aligned with first side aperture 106 in the housing 102 and side entry aperture 132 is aligned with second side aperture 108 in housing 102. A first ball valve 110 is then inserted into through bore 104 in housing 102 from the same end of the housing 102 as the flow adapter 114 was inserted. First ball valve 110 is retained in through bore 104 by abutting against the flow adapter 114, or alternatively, resting on a retaining member (not shown) and/or a shoulder 113 formed by a reduction of the internal diameter of housing 102. As shown in FIG. 5, the spacer assembly 116 is then placed into through bore 104 so that the split ring 118 is positioned above first ball valve 110 and external shoulder 124 of split ring insert 120 rests on the top of split ring 118. Second ball valve 112 is then inserted into through bore 104 so that the bottom of second ball valve 112 rests on the internal shoulder 122 of the split ring insert 120. If any component of the flowhead assembly needs to be replaced, the lift sub 400 is disconnected from the drilling equipment to which it is attached and the components can easily be pulled out of through bore 104 and replaced.

Referring to FIGS. 1 and 6, to assemble the side flow entry attachment 200, the first ball valve 212 is inserted into central passage 208 in housing 204 from one end of the housing 204. First ball valve 212 is retained in central passage 208 by a diameter restriction 210 of central passage 208. As suggested in FIG. 6, the spacer assembly 216 is then placed into central passage 208 so that the split ring 218 rests on first ball valve 212 and external shoulder 224 of split ring insert 220 rests on the top of split ring 218. Second ball valve 214 is then inserted into central passage 208 so that the bottom of second ball valve 214 rests on the internal shoulder 222 of the split ring insert 220. Flow guide insert 226 is then inserted into central passage 208 so that the side aperture 228 of the flow guide insert 226 is aligned with the side flow entry aperture 206 of housing 204. Then plug 234 is then inserted into central passage 208 to retain flow guide insert 226 in central passage 208. If any of the components of the side flow entry attachment needs to be replaced, the plug 234 is removed from central passage 208 and the components can easily be pulled out of central passage 208 and replaced.

Referring to FIG. 8, to assemble the frac head assembly 300, the flow adapter 310 is inserted into through bore 304. Flow adapter 310 is retained in through bore 304 by resting on a retaining member (not shown) and/or a shoulder 312 formed by a reduction of the internal diameter of housing 302. Flow adapter 310 is positioned such that first side entry aperture 316 is aligned with first aperture 306 in the housing 302 and second side entry aperture 318 is aligned with second aperture 308 in the housing 302. If the flow adapter 310 becomes worn or damaged and needs to be replaced, the lift sub 400 is disconnected from housing 302 and the flow adapter 310 can then be readily be removed and replaced. Naturally, the concept of employing a flow adapter in a frac head assembly is not limited to the particular frac head assembly illustrated in FIG. 8. For example, another typical frac head assembly would employ a pair (or series) of lifting eyes attached to housing 301 rather than incorporating the lift sub 400.

As required, detailed embodiments of the present invention are disclosed herein. However, it is to be understood that the disclosed embodiments are merely exemplary of the invention, which can be embodied in various forms. As such, any feature(s) used in one embodiment can be used in another embodiment. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention. While the specification concludes with claims defining the features of the invention that are regarded as novel, it is believed that the invention will be better understood from a consideration of the description in conjunction with the drawing figures, in which like reference numerals are carried forward.

Alternate embodiments may be devised without departing from the spirit or the scope of the invention. Additionally, well-known elements of exemplary embodiments of the invention are not be described in detail or are omitted so as not to obscure the relevant details of the invention.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The terms "connected" and/or "coupled," as used herein, are defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The term "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a approximations that may vary by (+) or (−) 20%, 15%, 10%, 5%, or 1%. In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

We claim:

1. A flowhead assembly comprising:
(a) a housing including:
(i) a through bore extending from a first end to a second end of the housing;
(ii) a first aperture extending from an external surface of the housing to the through bore; and
(iii) a second aperture extending from the external surface of the housing to the through bore;
(b) a first ball valve positioned within the through bore of the housing above the first and second aperture;
(c) a second ball valve positioned within the through bore of the housing above the first ball valve;
(d) a diameter restriction positioned below the first ball valve; and
(e) a side flow entry attachment in fluid communication with the first or second aperture of the housing, the side flow entry attachment including:
(i) a central passage extending from a first end of the side flow entry attachment to a second end of the side flow entry attachment;
(ii) a side entry aperture positioned through an exterior surface of the side flow entry attachment to the central passage;
(iii) a removable flow guide insert with a side aperture and a bottom aperture and a flow passage transitioning from the side aperture to the bottom aperture, the flow guide insert configured to slide into the central passage; and
(iv) a third ball valve positioned below the side entry aperture.

2. The flowhead assembly of claim 1, wherein the side flow entry attachment further includes a plug positioned above the flow guide insert.

3. The flowhead assembly of claim 1, wherein the flowhead assembly further includes a spacer assembly positioned between the first ball valve and the second ball valve where:
(a) the spacer assembly comprises:
(i) a split ring positioned above the first ball valve of the flowhead assembly;
(ii) a split ring insert, positioned above the split ring and below the second ball valve, including:
(A) an upper portion having a first external diameter and an internal shoulder that has a diameter that is less than a diameter of the second ball valve; and
(B) a lower portion having a second external diameter that is less than the first external diameter and an external shoulder that has a diameter that is greater than the internal diameter of the split ring.

4. The flowhead assembly of claim 1, wherein:
(a) the side flow entry attachment is in fluid communication with the first aperture of the flowhead assembly; and
(b) the flowhead assembly further includes a second side flow entry attachment, in fluid communication with the second aperture of the housing, including having:
(i) a central passage extending from a first end of the second side flow entry attachment to a second end of the second side flow entry attachment;
(ii) a side entry aperture positioned through an exterior surface of the second side flow entry attachment to the central passage;
(iii) a flow guide insert with a side aperture and a bottom aperture and a flow passage transitioning from the side aperture to the bottom aperture;
(iv) a fourth ball valve positioned below the side entry aperture; and
(v) a fifth ball valve positioned above the fourth ball valve and below the side entry aperture.

5. The flowhead assembly of claim 1, further comprising a flow adapter, positioned below the first ball valve and above the diameter restriction, including:
(a) an adapter body with an outer diameter smaller than an inner diameter of the flowhead through bore, the adapter body including a channel passage;
(b) a first side entry aperture, intersecting the channel passage, and aligned with the first aperture of the housing; and
(c) a second side entry aperture, intersecting the channel passage, and aligned with the second aperture of the housing.

6. The flowhead assembly of claim 5, wherein the flow adapter further comprises:
(a) a first chamfered internal surface about the first side entry aperture; and
(b) a second chamfered internal surface about the second side entry aperture.

7. The flowhead assembly of claim 5, wherein the adapter body is formed of at least two separable segments.

8. The flowhead assembly of claim 1, wherein the flow guide insert comprises a chamfered internal surface that includes a wear resistant material.

9. The flowhead assembly of claim 8, wherein the wear-resistant material is stainless steel or chrome.

10. A valve assembly comprising:
(a) a housing including:
(i) a central passage extending from a first end of the housing to a second end of the housing;
(ii) a side entry aperture extending from an external surface of the housing and intersecting the central passage; and
(iii) a diameter restriction positioned below the side entry aperture;
(b) a flow guide insert, positioned within the central passage of the housing, including:
(i) a side aperture aligned with the side entry aperture of the housing;
(ii) a bottom aperture aligned with the central passage of the housing; and
(iii) a flow passage transitioning from the side aperture to the bottom aperture;
(c) a first ball valve positioned in the central passage of the housing below the flow guide insert and above the diameter restriction;
(d) a second ball valve positioned below the flow guide insert and above the first ball valve and a spacer assembly positioned between the first ball valve and the second ball valve; and
(e) wherein the spacer assembly includes:
(i) a split ring positioned above the first ball valve; and
(ii) a split ring insert, positioned above the split ring and below the second ball valve, including:
(1) an upper portion having a first external diameter and an internal shoulder that has a diameter that is less than a diameter of the second ball valve; and
(2) a lower portion having a second external diameter that is less than the first external diameter and an external shoulder that has a diameter that is greater than the internal diameter of the split ring.

11. The valve assembly of claim 10, further comprising a plug extending into an upper end of the central passage of the housing.

12. The valve assembly of claim 10 wherein the flow passage comprises a chamfered internal surface that includes a wear resistant material.

13. The valve assembly of claim 10, wherein the bottom of the first ball valve is within 12 inches of the top of the second ball valve.

14. The valve assembly of claim 10, wherein the central passage of the housing has a first diameter at one end and a second diameter at a second end, where the second diameter is smaller than the first diameter and the diameter restriction is the second diameter.

15. A method of fabricating a valve assembly comprising the steps of:

(a) inserting a flow adapter into a first end of a central passage that extends from a first end of a housing to a second end of the housing, the flow adapter including a first side entry aperture intersecting the central passage and aligning with a first side aperture in the housing;

(b) inserting above the flow adapter a first ball valve into the first end of the central passage, where the central passage has a diameter restriction positioned below the first ball valve;

(c) inserting a spacer assembly into the first end of the central passage, where the spacer assembly is positioned above the first ball valve and the spacer assembly includes:

(i) a split ring positioned above the first ball valve; and (ii) a split ring insert, positioned above the split ring and below a second ball valve, including:

(1) an upper portion having a first external diameter and an internal shoulder that has a diameter that is less than a diameter of the second ball valve; and (2) a lower portion having a second external diameter that is less than the first external diameter and an external shoulder that has a diameter that is greater than the internal diameter of the split ring; and (d) inserting the second ball valve into the first end of the central passage, where the second ball valve is positioned above the spacer assembly.

16. The method of claim 15, further comprising the step of:

(a) inserting a plug into the first end of the housing, where the plug extends into the first end of the housing.

17. The method of claim 15, wherein the flow adapter comprises:

(a) a second side entry aperture, intersecting the central passage, and aligned with a second side aperture of the housing;

(b) a first chamfered internal surface about the first side entry aperture; and (c) a second chamfered internal surface about the second side entry aperture.

18. The method of claim 15, wherein the flow adapter forms a flow guide insert which includes:

(i) a bottom aperture aligned with the central passage of the housing; and (ii) a flow passage transitioning from the first side entry aperture to the bottom aperture.

* * * * *